United States Patent [19]

Kay et al.

[11] Patent Number: 5,027,977

[45] Date of Patent: Jul. 2, 1991

[54] AUTOMATIC INFLATION VALVE

[76] Inventors: Francis X. Kay, The School House, Addington, Buckingham MK1 2JS; Keith A. Smith, Windrush, Nursery Close, Hilperton, Nr. Trowbridge, Wiltshire, both of England

[21] Appl. No.: 385,919

[22] Filed: Jul. 27, 1989

[30] Foreign Application Priority Data

Jul. 27, 1988 [GB] United Kingdom ..... 8817931

[51] Int. Cl.[5] ..... B67B 5/00

[52] U.S. Cl. ..... 222/5; 441/93

[58] Field of Search ..... 222/3, 5, 80–83.5, 222/91; 441/90, 92–94

[56] References Cited

U.S. PATENT DOCUMENTS

| | | | |
|---|---|---|---|
| 2,946,484 | 7/1980 | Stoner | 222/5 |
| 3,490,649 | 1/1970 | Sheridan | 441/94 X |
| 3,716,882 | 2/1973 | Middleton | 441/94 |
| 3,811,461 | 5/1974 | Novak | 222/5 X |
| 4,191,310 | 3/1980 | Bernhardt et al. | 222/5 X |
| 4,223,805 | 9/1980 | Mackal | 222/5 |
| 4,498,881 | 2/1985 | Buckle | 441/93 |
| 4,805,802 | 2/1989 | MacKendrick et al. | 222/5 |

FOREIGN PATENT DOCUMENTS 2432629 2/1980 France .

*Primary Examiner*—Michael S. Huppert
*Assistant Examiner*—Philippe Derakshani
*Attorney, Agent, or Firm*—Nixon & Vanderhye

[57] ABSTRACT

An automatic valve for inflating an inflatable article, includes a pin for piercing an operculum seal of a container for a compressed gas, a spring for urging the pin in a first direction to pierce the operculum seal of a compressed gas container, an arming mechanism for causing movement of the pin against the spring into an armed position and a latching mechanism including a pressurizable compartment for latching the pin in the armed position. The latching mechanism is arranged so as to release the pin on release of pressure of the pressurizable compartment, and a release mechanism for causing the release of pressure from the pressurizable compartment on immersion of the valve in water.

16 Claims, 4 Drawing Sheets

AUTOMATIC INFLATION VALVE

Figure 1:
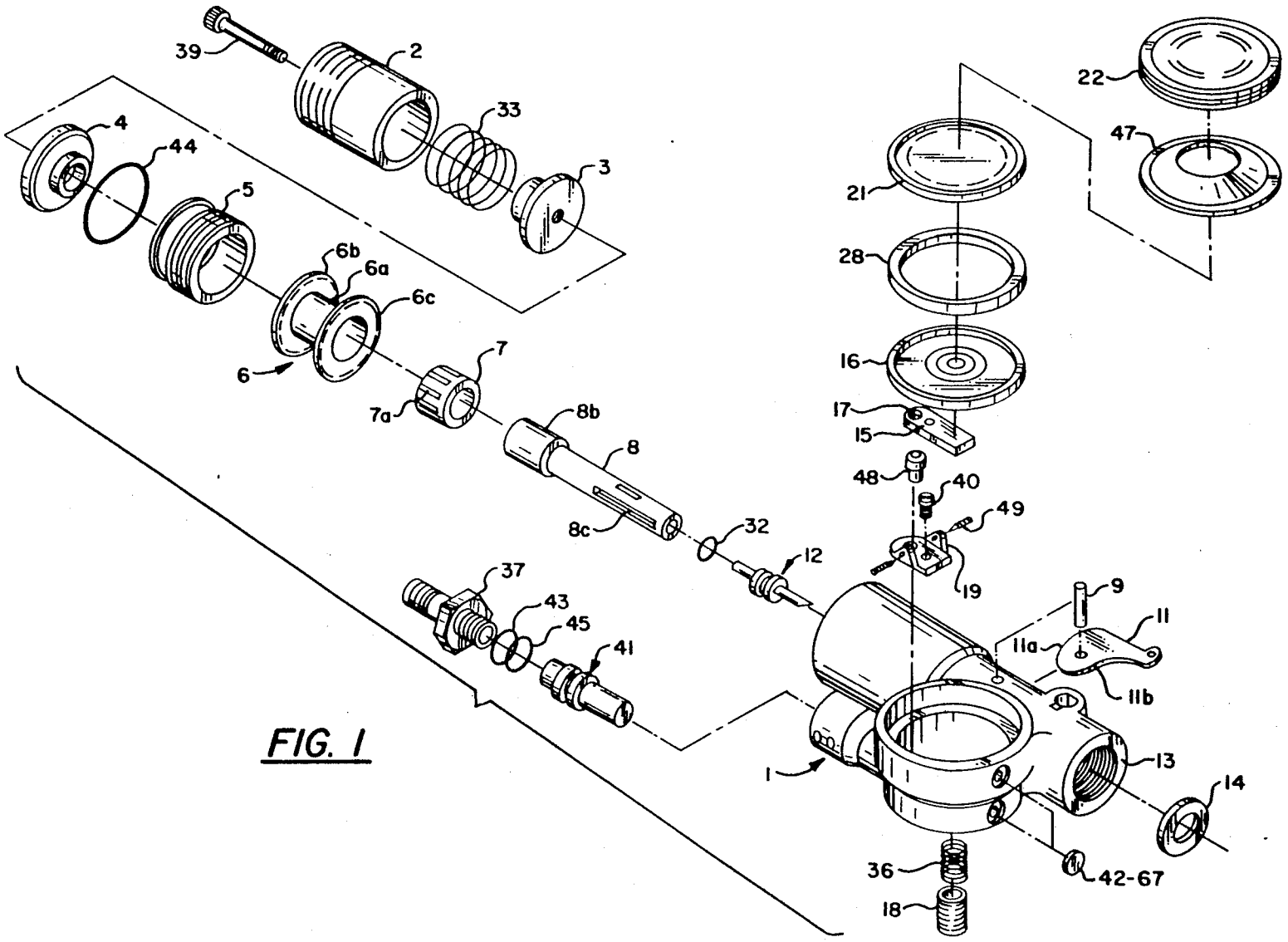

This invention relates to automatic valves, suitable for inflating automatically articles such as life jackets, inflatable life rafts and the like.

One such device is disclosed in our U.S. Pat. No. 4,498,881. The device shown in the earlier U.S. Patent depends for its operation on the release of compressed air from a cylinder, enabling a compression spring to force a piston to pierce an operculum seal.

In operation, it is sometimes found that the compressed air cannot be released from the cylinder sufficiently quickly to enable a sufficient force to be achieved to pierce the operculum seal.

In accordance with the present invention, there is provided an automatic valve for inflating an inflatable article, comprising means for piercing an operculum seal of a container for compressed gas, resilient means for urging the piercing means in a first direction, thereby in use to pierce the operculum seal of a compressed gas container, means for causing movement of the piercing means against the said resilient means into an armed position, latching means including a pressurisable compartment for latching the piercing means in the armed position, wherein the latching means is arranged so as to release the piercing means on release of pressure in the pressurisable compartment, and a release mechanism for causing the release of pressure from the pressurisable compartment on immersion of the valve in water.

The latch means preferably includes a collet for retaining the piercing means in the armed position, and a pressurisable cuff, arranged to maintain pressure on the collet when the cuff is pressurised, to maintain the valve in the armed position, and to release pressure on the collet to cause firing of the piercing means when the cuff is not pressurised.

The piercing means, the collet and the cuff may be housed in a barrel, and the cuff may preferably comprise a flexible moulding, having a sleeve portion, a peripheral collar portion at each end of the sleeve portion, and a peripheral bead on each collar portion for sealing the cuff moulding against the valve body to define the pressurisable cuff.

A pressure reservoir may be provided for maintaining the pressure in the cuff, and connected with the cuff by means of a passageway, a second passageway communicating between the cuff and the release mechanism. Each passageway is preferably provided with a restricted orifice, the orifice in the second passageway being larger than that in the first. By this means, the cuff is maintained reliably at the latching pressure by the reservoir, but on release of the release mechanism, firing takes place rapidly, because the egress of fluid (normally air) through the second orifice is more rapid than ingress of air through the first.

The release mechanism preferably includes a gas release orifice, and a lever having a valve seat for closing the orifice. The lever is normally biased against the orifice, such that the valve seat closes the orifice. Operation of the valve is caused by providing means responsive to ambient pressure, for example a diaphragm, for urging the lever against the bias means, thereby to open the orifice, when ambient pressure increases. The side of the diaphragm not open to ambient will generally face an internal closed compartment of the valve.

It has also been discovered that the rate of firing of an orifice/lever valve as described above can be substantially increased by providing a dished region around the orifice, such that when the valve seat begins to lift from the orifice, turbulence in the compressed gas is caused by deflection of tho gas by the seat towards the dish, and this results in increased pressure for lifting the valve seat.

The internal compartment which is beneath the diaphragm may be separated from the ambient surroundings by an air permeable but water impermeable divider. The use of such a divider increases the sensitivity of the device, by allowing the egress of air from the compartment beneath the diaphragm when pressure is applied to the exterior of the diaphragm, for example by being immersed in water, whilst preventing the flow of water into the compartment. Preferably, a second diaphragm is employed, having an area less than that of the first diaphragm, and spaced from the first diaphragm. The second diaphragm is coupled to the first diaphragm in such a manner as to increase the force available for triggering the release mechanism.

In a particularly preferred embodiment, the space between the diaphragms and/or the space beneath the second diaphragm may be separated from the ambient surroundings by an air permeable but water impermeable divider. The air permeable material may preferably be a porous polymeric material, such as polyethylene or polyurethane, and is preferably somewhat hydrophobic, in order to diminish surface tension effects.

Particularly preferable materials are the porous polyethylene materials sold under the Trade Mark PORVAIR, or more preferably, the porous polyurethane material sold under the Trade Mark PERMAIR, which is somewhat more hydrophobic than PORVAIR.

Figure 2:
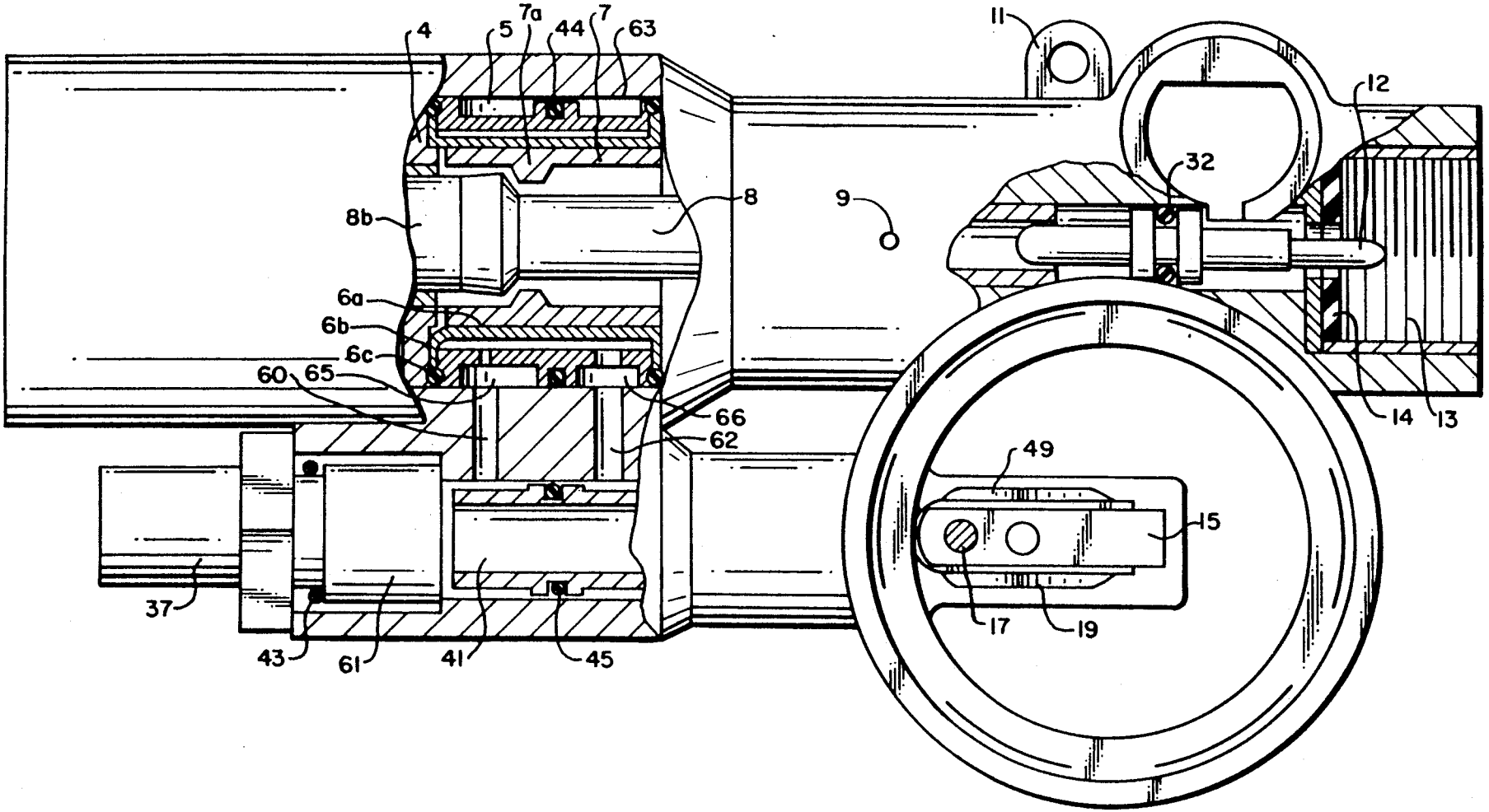
Figure 3:
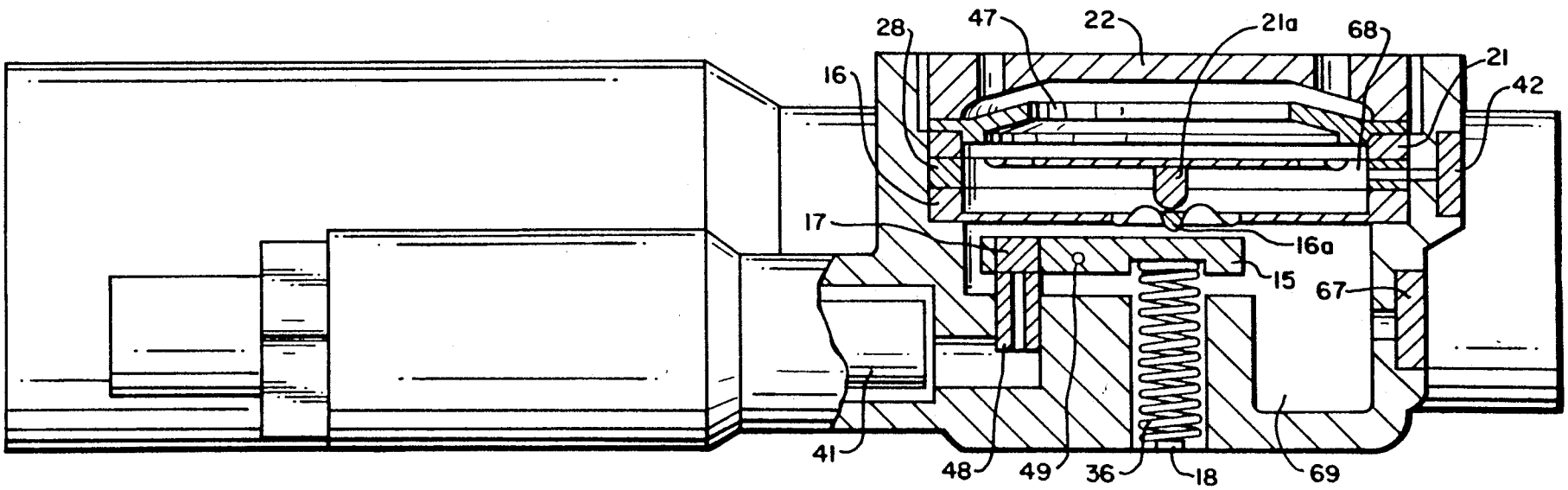
Figure 4A:
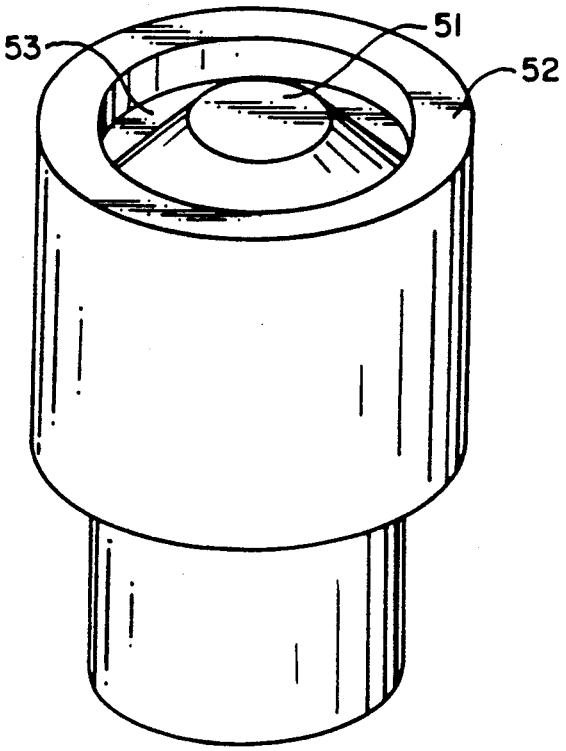
Figure 4B:
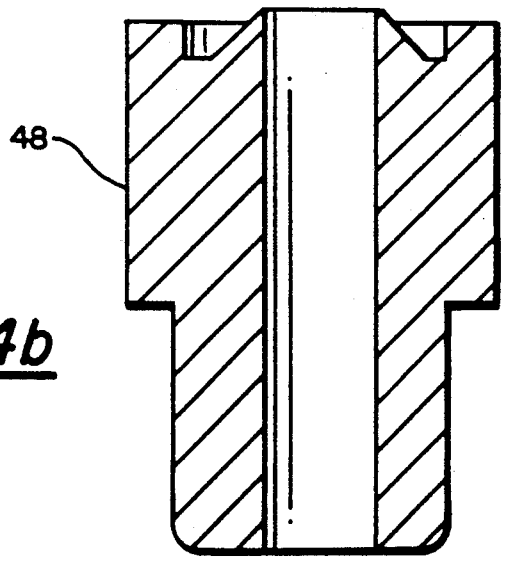

A preferred embodiment of the invention will now be described with reference to the accompanying drawings, in which:

FIG. 1 is an exploded view of an automatic valve for inflating an article, in accordance with the invention, FIG. 2 is a plan view, partially in section, of the valve of FIG. 1, FIG. 3 is a side elevation, partially in section, of the valve of FIG. 1, and FIGS. 4*a* and 4*b* are enlarged perspective and sectoral views respectively views of jet 48 shown in FIG. 1.

Referring to FIGS. 1, 2 and 3, the automatic valve comprises a main body portion 1 to which a pressurised bottle for compressed carbon dioxide may be affixed by means of a screw thread 13, such that the neck of the bottle is sealed by a sealing ring 14. The bottle (not shown) has an operculum seal, and a striker pin 12 is positioned so as to pierce the operculum seal on its release from an armed position, driven by load spring 33. Load spring 33 is located within body 1, and is held in position by means of a retainer 2 and retaining screw 39, located in spring seat. The assembly is then screwed into body 1, and engages a cuff clamp plate 4. Striker pin 12 is free to move along its length within body 1, and has its end remote from the operculum seal received within a firing plunger 8.

Firing plunger 8 passes through a cam collet 7, cuff 6 and spacer 5. As shown in FIG. 2, when the valve is assembled, cuff moulding 6 lies within spacer 5. Cuff moulding 6 includes a sleeve portion 6*a*, peripheral collar portions 6b, and peripheral bead 6c. When the valve is assembled, beads 6c are clamped between spacer 5 and body 1, or between spacer 5 and cuff clamp plate 4 to define an inflatable cuff, between cuff moulding 6, and spacer 5.

Cam collet 7 has cam dogs 7a, which are so arranged as to bear resiliently on camming surface 8b of firing plunger 8. In use, cam collet 7 and firing plunger 8 both lie within cuff moulding 6, such that when the cuff is pressurised, the cuff moulding 6 retains dogs 7a against camming surface 8b, and thus retains the firing plunger 8 in the armed position.

The inflatable cuff is provided with an inlet passageway 60 to a reservoir 61, and an outlet passageway 62 to an air release mechanism, which will be described in more detail hereinafter. Passageways 60 and 62 are separated from each other by means of an '0' ring 45 on supply divider pin 41. Reservoir 61 is provided with a standard valve 37 for inflation, sealed to reservoir 61 by means of an '0' ring 43.

Passageway 60 and 62 both communicate with a barrel 63 in housing 1, in which the firing plunger 8, cam collet 7, and cuff moulding 6 are housed.

A first orifice 65 in cuff spacer 5 communicates between passageway 60 and cuff moulding 6, and a second passageway 66, in cuff spacer 5 larger than the first passageway 65, communicates between cuff moulding 6 and the pressure release mechanism. '0' ring 44 serves to divide orifice 65 from orifice 66. In use therefore, the release of pressure through passageway 62 allows for rapid deflation of the cuff, and firing of the device, notwithstanding the fact that reservoir 61 is able to maintain the cuff under pressure via orifice 65.

The firing mechanism is best illustrated in FIG. 3. The firing mechanism includes a nozzle 48, which communicates with passageway 62. Nozzle 48 has an opening 51, and a surrounding skirt 52, defining a dished region 53 between the skirt 52 and opening 51. As can be seen in FIGS. 4a and 4b, the skirt 52 is slightly below the level of opening 51.

A lever 15, having a valve seat 17 at one of its ends, is pivoted at or about its mid point 49. A spring 36 urges lever 15 towards nozzle 48, such that the valve seat 17 closes orifice 51. The compression force in spring 36 may be adjusted by means of adjusting screw 18. Thus, a small force applied to lever 15 will result in the release of pressure through orifice 51 from cuff moulding 6, and thus the firing of the valve.

The release mechanism for lever 15 includes a pair of diaphragms 16 and 21, spaced by a diaphragm spacer 28. The operating area of diaphragm 21 is substantially greater than that of diaphragm 16, thus resulting in an overall thrust gain. An operating pin 21a moulded to the centre of diaphragm 21 bears on the upper part of a second operating pin 16a, formed on the centre part of diaphragm 16. The lower part of diaphragm 16 bears on lever 15, against biass spring 36.

PORVAIR (Trade Mark) plugs 42 and 67 separate the space 68 between the diaphragm and the space 69 between diaphragm 16 respectively from the ambient surroundings.

A diaphragm buffer plate 47 and cover 22 retain the diaphragms within the housing 1.

Arming of the device is carried out by means of arming lever 11, which is free to pivot on pivot pin 9, received in body 1. Arming lever 11 is received in a slot 8c in firing plunger 8, and is provided with camming surfaces 11a and 11b.

Arming of the device is achieved by first pressurising reservoir 61, and thereby cuff 6. Arming lever is then rotated about pin 9 such that camming surface 11a urges plunger 8 against spring 33, until camming surface 8b is latched by dogs 7a. A consequence of the shape of the lever 11 is that, as lever is rotated, camming surface 11b of lever 11 urges striker pin 12 in the opposite direction, so that firing lever 11 may be used for manual firing of the valve. It will be appreciated that for this reason, arming of the device can be carried out only before a gas bottle has been fitted to connector 13.

Once armed, the device will remain armed until valve seat 17 is lifted from orifice 51. It has been found in practice that a device as illustrated above will remain armed for many months, without accidental firing. When the automatic valve is immersed in water, the ambient pressure on diaphragm 21 is increased, thus causing displacement of diaphram 21 and 16 downwardly. Semi-permeable plugs 42 and 67 prevent the back pressure in compartment 68 and 69 being correspondingly increased. Thus, operating pin 16a bears on lever 15, to cause lifting of valve seat 17. The dished region of nozzle 48 causes increased turbulence, which assists in the lifting of the valve seat 17. On release of pressure from the cuff moulding 6, load spring 33 is able to overcome the resilience of collet dogs 7a, and thus the firing plunger operates, the striker pin 12, to pierce the operculum seal.

The presence of the semi-permeable plugs 42 and 67 enables the automatic valve to be maintained in a pressurised environment, for example in a aircraft cabin or pressured citadel, without triggering, since air in compartment 68 and 69 is maintained at ambient pressure, via the porous plus 42 and 67. When immersed in water however, this pressure equalisation does not occur, and it has been found that firing can be achieved at depths as low as 10 to 20 cm.

It will of course be appreciated that a wide range of different arrangements are possible, in addition to those specifically described above.

We claim:

1. An automatic valve for inflating an inflatable article, comprising means for piercing an operculum seal of a container for compressed gas, resilient means for urging the piercing means in a first direction, thereby in use to pierce the operculum seal of a compressed gas container, means for causing movement of the piercing means against the said resilient means into an armed position, latching means including a pressurisable compartment for latching the piercing means in the armed position, wherein the latching means is arranged so as to release instantly the piercing means on release of pressure of the pressurisable compartment, and a release mechanism for causing the release of pressure from the pressurisable compartment on immersion of the valve in water.

2. A life jacket or an inflatable vessel incorporating a valve as claimed in claim 1.

3. An automatic valve for inflating an inflatable article, comprising means for piercing an operculum seal of a container for compressed gas, resilient means for urging the piercing means in a first direction thereby in use to pierce the operculum seal of a compressed gas container, means for causing movement of the piercing means against said resilient means into an armed position, latching means including a collet and a pressurizable compartment in the form of a pressurizable cuff, arranged to maintain pressure on the collet when the cuff is pressurized to maintain the piercing means in the armed position, and to release pressure on the collet to permit firing of the piercing means when depressurized, and a release mechanism for causing the release of pressure from the pressurizable compartment on immersion of the valve in water.

4. A valve as claimed in claim 3, wherein the latching means includes a barrel for receiving the collet the cuff and the piercing means, and wherein the cuff comprises a flexible moulding having a sleeve portion, a peripheral collar portion at each end of the sleeve and a peripheral bead on each said collar portion for sealing the said moulding against the barrel to define the pressurisable cuff.

5. A valve as claimed in claim 3, wherein the latching means includes a pressure reservoir, connected to the pressurisable compartment.

6. A valve as claimed in claim 5, including a first passageway including a first restricted orifice, communicating between the reservoir and the pressurisable compartment, and a second passageway including a second restricted orifice, communicating between the pressurisable compartment and the release mechanism, wherein the second restricted orifice is larger than the first oriface.

7. A valve as claimed in claim 3, wherein the release means includes a gas release orifice, a lever provided with a valve seat for closing the orifice, bias means for urging the valve seat against the orifice to close the orifice, and means responsive to ambient pressure for urging the lever against the bias means to open the orifice, on an increase in ambient pressure.

8. A valve as claimed in claim 3, wherein the release mechanism includes a first diaphragm, open on one side to the ambient surroundings, wherein the other side of the first diaphragm faces an internal compartment of the valve.

9. A valve as claimed in claim 8, wherein the said internal compartment is a closed compartment.

10. A valve as claimed in claim 9, wherein the said internal compartment is separated from the ambient surroundings by an air permeable but water impermeable divider.

11. A valve as claimed in claim 8, wherein the release mechanism includes a second diaphragm, having an area less than that of the first diaphragm, the second diaphragm being spaced from the first diaphragm, and coupled thereto to produce an increase in operating force in comparison with that which would be obtained by use of the first diaphragm alone.

12. A valve as claimed in claim 11, wherein the space between the said first and second diaphragm is separated from the ambient surroundings by an air permeable but water impermeable divider.

13. A valve as claimed in claim 11, wherein the side of the second diaphragm which faces away from the first diaphragm faces a closed compartment, which is separated from the ambient surroundings by an air permeable but water impermeable divider.

14. A valve as claimed in claim 10, wherein the air permeable divider is formed of a porous polymeric material.

15. A valve as claimed in claim 14, wherein the material is polyethylene or polyurethane.

16. A valve as claimed in claim 14, wherein the material is a hydrophobic material.

* * * * *